US006176469B1

(12) United States Patent
Bigham

(10) Patent No.: US 6,176,469 B1
(45) Date of Patent: Jan. 23, 2001

(54) MANHOLE COVER ENGAGING TOOLS

(76) Inventor: Vern Bigham, 354 Forest La., Mankato, MN (US) 56003

( * ) Notice: Under 35 U.S.C. 154(b), the term of this patent shall be extended for 0 days.

(21) Appl. No.: 09/551,499

(22) Filed: Apr. 18, 2000

(51) Int. Cl.[7] ..... B66F 3/00

(52) U.S. Cl. ..... 254/131; 254/133 R; 254/134; 294/97; 294/82.1

(58) Field of Search ..... 254/131, 133 R, 254/134; 294/97, 82.1, 82.18, 89

(56) References Cited

U.S. PATENT DOCUMENTS

| | | | | |
|---|---|---|---|---|
| 1,334,839 | * | 3/1920 | Cole | 294/97 |
| 1,427,576 | | 8/1922 | Bryant . | |
| 3,985,338 | | 10/1976 | Herrmann . | |
| 4,157,810 | | 6/1979 | Haller et al. . | |
| 4,365,786 | | 12/1982 | Osteen . | |
| 4,612,730 | | 9/1986 | Gundy . | |
| 4,621,941 | | 11/1986 | Ditcher et al. . | |
| 4,695,037 | | 9/1987 | Hadbavny . | |
| 4,793,646 | | 12/1988 | Michaud, Jr. . | |
| 4,991,893 | | 2/1991 | Gordon et al. . | |
| 5,165,661 | | 11/1992 | Wright . | |
| 5,431,459 | | 7/1995 | Gundy . | |
| 5,462,385 | | 10/1995 | Mohlengraft . | |
| 5,529,287 | * | 6/1996 | Pelosi, Jr. et al. | 254/131 |
| 5,531,541 | | 7/1996 | Clover et al. . | |
| 5,674,045 | | 10/1997 | Eckloff et al. . | |
| 5,775,674 | | 7/1998 | Bigham . | |
| 5,865,425 | | 2/1999 | Meadows . | |
| 5,947,633 | | 9/1999 | Foss . | |

* cited by examiner

*Primary Examiner*—Derris H. Banks
*Assistant Examiner*—Lee Wilson
(74) *Attorney, Agent, or Firm*—Kinney & Lange, P.A.

(57) ABSTRACT

A manhole cover engaging tool includes a first and second L-shaped member. The first and second L-shaped members are hingedly attached along a shank of the first and second L-shaped members. A first plate is attached to a first end of a first L-shaped member. A second plate is attached to a first end of the second L-shaped members. The first plate and the second plate configure to cooperate with a lever when the manhole cover engaging tool is in an engaging position.

8 Claims, 5 Drawing Sheets

Fig. 1
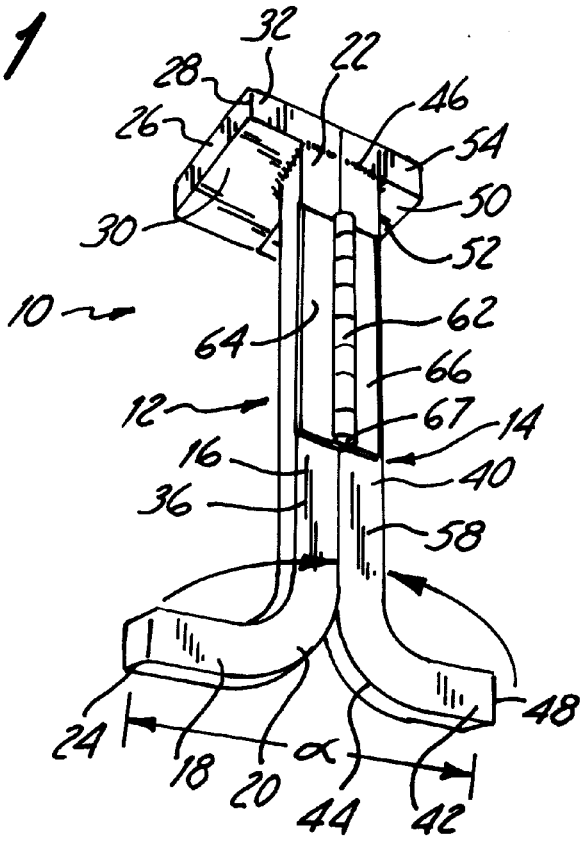
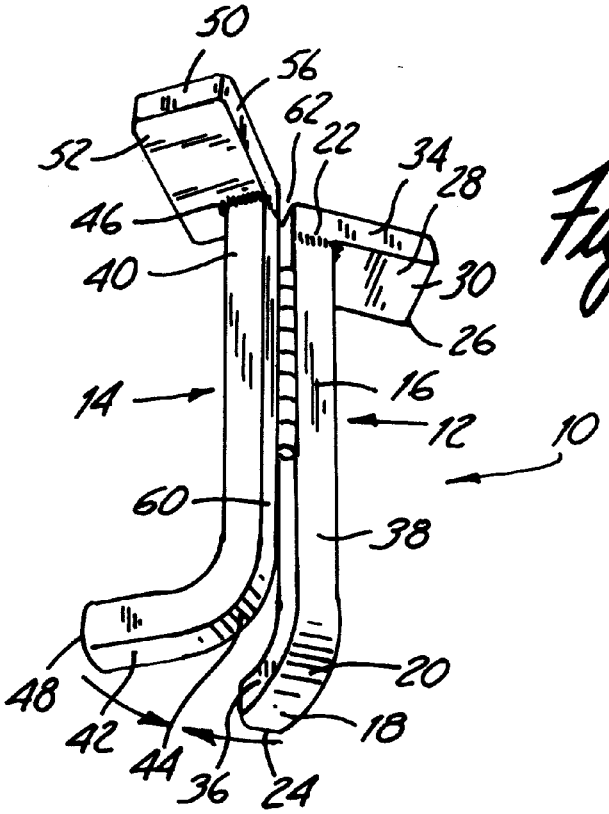
Fig. 2

76
68
70
72
78
98
96
88
84
90
92
94
86
82
80
74
77

320
318
334
314
312
328
310
330
340
346
316
352
338
336
342
354
326
324
350
322
348

MANHOLE COVER ENGAGING TOOLS

BACKGROUND OF THE INVENTION

The present invention relates to a lift apparatus for lifting a manhole cover. More particularly, the present invention relates to a manually operated manhole cover engaging tool.

Utility covers, also known as "manhole" covers, are frequently used to cap entrances to subsurface enclosures. For example, manhole covers are often used to cover the openings to sanitary and storm sewers, subsurface telephone cable and communication line junction boxes, electrical enclosures, and enclosures providing access to subterranean pipes.

Most manhole covers are constructed of thick metal, commonly iron, and are often very heavy usually weighing over 50 pounds. The great strength and weight of manhole covers serve a number of purposes, including preventing unauthorized access to the enclosure by children or other persons, preventing inadvertent movement and displacement of the manhole cover by vehicles, and providing a solid base for people and transportation equipment traveling over the manhole.

However, the weight of manhole covers also poses a significant problem to their use because they are difficult and sometimes hazardous to remove. The fact that manhole covers are usually heavy, combined with the fact that they are usually positioned at ground level, means that a worker trying to remove a manhole cover usually attempts to lift the heavy manhole cover from a bent-over position. This bent-over lifting position can lead to back injuries, which result in pain and suffering. These injuries also cause lost productivity and income for employees and employers.

A conventional method of removing manhole covers is to pry the edge of the manhole cover upward with a pick, and then rotate the cover away from the opening with either the pick or another tool, such as a shovel or pry-bar. Conventional removal methods often require that the worker removing the cover grab the edge of the cover. Grabbing a manhole cover can be very hazardous, because workers risk crushing their fingers under the weight of the cover or severely pinching their fingers between the cover and the rim of the manhole. Also, use of the hands usually means that the worker is bent over the manhole, providing additional concern about back injury.

Conventional apparatuses and methods of opening manholes also pose the problem that the worker must be relatively close to the manhole while removing the cover. The proximity of the worker to the manhole can be problematic because manholes are often very deep, and falling into an open manhole can cause severe injuries or even death. Under some circumstances, such as overflowing sewers or ruptured water mains, water may be leaking out of the top of the manhole, creating a slippery, wet surface proximate the manhole opening. This slippery surface can be especially troubling during winter when ice forms proximate the manhole. Therefore, it is desirable for a manhole opener to permit the removal of the manhole cover while the worker is a safe distance from the opening.

A further problem associated with removing manhole covers is that not all manhole covers can be removed in the same manner. Some covers have a small round opening in the middle of the cover. Other manhole covers have a slot or depression on the outer edge of the cover, while still others have one or more slots, holes, or depressions positioned between the edge and the center of the manhole. These various configurations can be a challenge to open, and may require specialized tools for each manhole.

Another problem associated with removing manhole covers is the difficulty in replacing the manhole cover. Under a conventional method, a pick is used to pry up the edge of the cover, which is then manually flipped up onto its side, rolled over to the opening, and then slowly rotated into place. This is a tedious and somewhat difficult task because of the great weight of the cover. Also, two people are often required to easily replace the manhole cover, the first to pry the edge off the ground, and the second to flip the manhole cover into a vertical position and roll it into place.

Accordingly, there is a need for an apparatus and method for safely, easily, and efficiently removing and replacing a manhole cover. Even further, there is a need for an apparatus which permits one person to remove and replace a manhole cover with a minimum of stress and danger, and a reduced risk of injuries to hands, feet, and backs.

BRIEF SUMMARY OF THE INVENTION

The present invention includes a tool for engaging and lifting a manhole cover. The manhole cover engaging tool includes a first L-shaped member and a second L-shaped member which are pivotally attached by a hinge along a shank of each the first and second L-shaped members. Attached to a first end of each of the first and second L-shaped members are a first and second plate which are used to engage an end of a lever.

BRIEF DESCRIPTION OF THE DRAWINGS

FIG. 1 is a perspective view of a manhole cover engaging tool of the present invention in an engaging position.

FIG. 2 is a perspective view of a manhole cover engaging tool with the second ends being moved toward each other.

DETAILED DESCRIPTION

Figure 3:
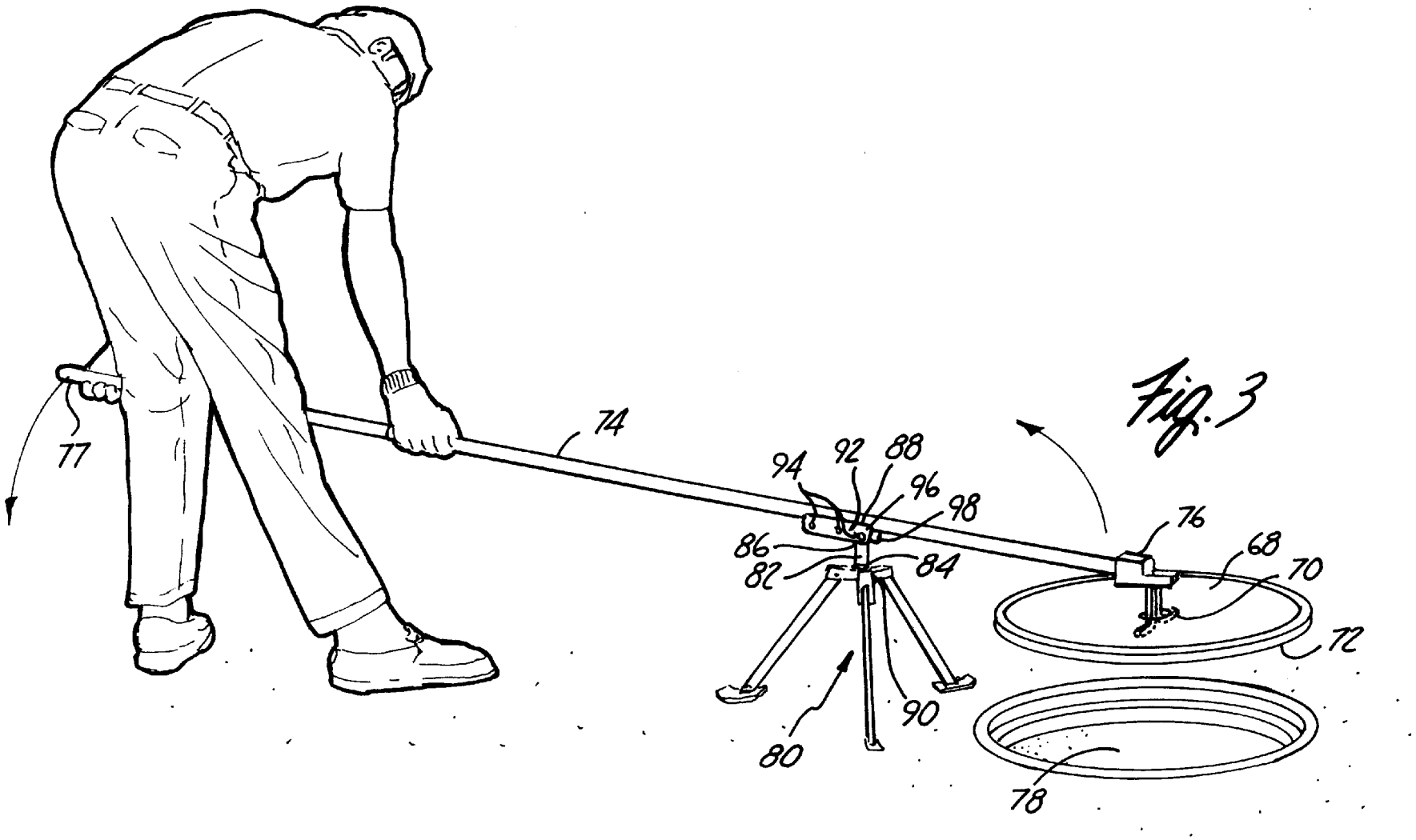
FIG. 3 is a perspective view of the manhole cover engaging tool in use while lifting a manhole cover using a base and a lever.

A manhole cover engaging tool 10 of the present invention is illustrated in FIGS. 1 and 2. The manhole cover engaging tool 10 includes a first L-shaped member 12 and a second L-shaped member 14.

The first L-shaped member 12 includes a first shank 16 and a first finger 18. Preferably the first shank 16 and the first finger 18 are formed from a single piece of material wherein a curved region 20 transitions the single piece of material from the first shank 16 to the first finger 18 wherein the single piece of material is preferably rectangular in cross section. The first shank 16 and the first finger 18 are in a substantially orthogonal relationship.

A bottom surface 30 of a first plate 26 is attached to a first end 22 of the first shank 16, preferably by a weld. The bottom surface 30 preferably is rectangular in configuration wherein the first end 22 of the first shank 16 is attached to the bottom surface 30 in a corner. For reasons that will become apparent later, a first surface 36 of the first shank 16 is substantially in the same plane as a first side surface 32 of the first plate 26, and a second surface 38 of the first shank 16 is substantially in the same plane as a second side surface 34 of the first plate 26.

The second L-shaped member 14 also includes a second shank 40 and a second finger 42 having substantially the same dimensions as the first shank 16 and the first finger 18 of the first L-shaped member 12. Preferably the second shank 40 and the second finger 42 of the second L-shaped member 14 are formed from a single piece of material wherein a curved region 44 transitions the single piece of material from the second shank 40 to the second finger 42. Preferably the piece of material is rectangular in cross section. The second shank 40 and the second finger 42 are in a substantially orthogonal relationship.

A first end 46 of the second shank 40 is attached to a bottom surface 52 of a second plate 50, preferably by a weld. The bottom surface 52 preferably is rectangular in configuration wherein the first end 46 of the second shank 40 is attached to the bottom surface 52 in a corner.

For reasons that will become apparent later, a first surface 58 of the second shank 40 is substantially in the same plane as a first side surface 54 of the second plate 50 and a second surface 60 of the second shank 40 is substantially in the same plane as a second side surface 56 of the second plate 50.

A hinge 62 pivotally connects the first L-shaped member 12 to the second L-shaped member 14. A first section 64 of the hinge 62 is attached to the first surface 36 of the first shank 16 proximate the first end 22. Similarly, a second section 66 of the hinge 62 is attached to the first surface 58 of the second shank 40 proximate the first end 46. The first and second sections 64,66 of the hinge 62 are preferably welded to the first surfaces 36, 58 of the first and second shanks 16, 40 respectively. A pin 67 pivotally attaches the first and second sections 64,66.

In operation, the manhole cover engaging tool 10 is used to maneuver a manhole cover 68 having a through hole 70 as illustrated in FIG. 3. The first L-shaped member 12 and the second L-shaped member 14 are pivoted about the hinge 62 such that a second end 24, 48 of the first and second L-shaped members 12, 14, respectively, are substantially adjacent as illustrated in FIG. 2. With the second ends 24, 48 of the first and second L-shaped members 12, 14 substantially adjacent, the first and second fingers 18, 42 of the first and second L-shaped members 12, 14 are inserted into the through hole 70 in the manhole cover 68. The manhole cover engaging tool 10 is manipulated such that the first and second fingers 18, 42 are substantially parallel to a bottom surface 72 of the manhole cover 68 and the first and second shanks 16, 40 are substantially perpendicular to the manhole cover 68.

The first and second L-shaped portions 12, 14 are pivoted about the hinge 62 such that the second surfaces 38, 60 of the first and second shanks 16, 40 are adjacent to each other as illustrated in FIG. 1. When the second surfaces 38, 60 of the shanks 16, 40 abut each other, the second side surfaces 38, 56 of the first and second plates 28, 50 are adjacent to each other, configuring the first and second plates 28, 50 such that a first end 76 of a lever 74 securely engages the first and second plates 28, 50 as illustrated in FIG. 3. With the second surfaces 38, 60 of the first and second shanks 16, 40 abutting each other, a distance, between the second ends 24, 48 of the first and second L-shaped members 12, 14, as best illustrated in FIG. 1 is greater than a diameter of the through hole 70, as best illustrated in FIG. 3, thereby positioning the manhole cover engaging tool 10 in an engaging position and preventing the manhole cover engaging tool 10 from disengaging from the manhole cover 68.

A base 80 is positioned proximate the manhole 78. Preferably, the base 80 has a tripod configuration. A first end 84 of a cylindrical member 82 is rotatably attached to a top surface 90 of the base 80. A pair of apertures (not shown) proximate a second end 86 of the cylindrical member 82 are aligned such that a pin 88 can be inserted through the pair of apertures (not shown).

The lever 74 having the first end 76 and a second end 77 is used to engage the manhole cover engaging tool 10 with the manhole cover 68. The first end 76 is adapted to receive the first and second plate 28, 50 which secures the manhole cover engaging tool 10 to the lever 74.

A bracket 92 is attached to the lever 74 between the first end 76 and the second end 77 preferably by a weld. The bracket includes a series of aligned apertures 94. The pin 88 is inserted through an aperture 94 in a first member 96 of the bracket, the aligned apertures (not shown) in the cylindrical member 82, and an aperture (not shown) in a second member 98 of the bracket 92, thereby pivotally attaching the lever 74 to the base 80, providing for vertical movement of the manhole cover engaging tool 10 and the manhole cover 68 while the rotational movement of the cylindrical member 82 provides sideways movement.

A downward force is applied to the second end 77 of the lever 74 as illustrated in FIG. 3. The base 80 acts as a fulcrum for the lever 74, therefore a downward force applied to the second end 77 of the lever 74 applies an upward force to the first end 76 of the lever. The upward force on the first end 76 of the lever 74 causes an engagement of the fingers 18, 42 of the L-shaped members 12, 14 with the bottom surface 72 of the manhole cover 68. One skilled in the art will appreciate the positioning of the base 80 with respect to the two ends 76, 77 of the lever 74 by adjusting the location of the pivotal attachment changes the amount of downward force applied to the second end 77 of the lever 74 required to lift the manhole cover 68.

As the downward force is applied to the second end 77 of the lever 74, the manhole cover engaging tool 10 raises the manhole cover 68 from the manhole 78. The manhole cover 68 is pivoted to one side or the other of the manhole 78. A downward force to the second end 77 must still be applied while the manhole cover 68 is pivoted to the side of the manhole 78. Once the manhole cover 68 has been pivoted a satisfactory distance from the manhole 78, the downward force on the second end 77 of the lever 72 may be gradually reduced so as to set down the manhole cover 68 onto a surface.

One skilled in the art will appreciate that the manhole cover engaging tool 10 is designed to cooperate with a manhole cover 68 having a substantially centrally located through hole 70. The center of gravity of a circular manhole cover 68 is substantially centrally located, therefore when the manhole cover engaging tool 10 engages the manhole cover 68, the center of gravity of the manhole cover 68 is proximate the manhole cover engaging tool 10. Because the center of gravity of the manhole cover 68 is proximate the manhole cover engaging tool 10, the manhole cover 68 is substantially balanced on the manhole cover engaging tool 10.

When the through hole 70 in a manhole cover 68 is not centrally located, an alternative embodiment 110 or another alternative embodiment 210 of the present invention compensates for engaging the manhole cover 68 a distance from the center of gravity. The alternative embodiment 110 is illustrated in FIG. 4 and the alternative embodiment 210 is illustrated in FIG. 5.

Figure 4:
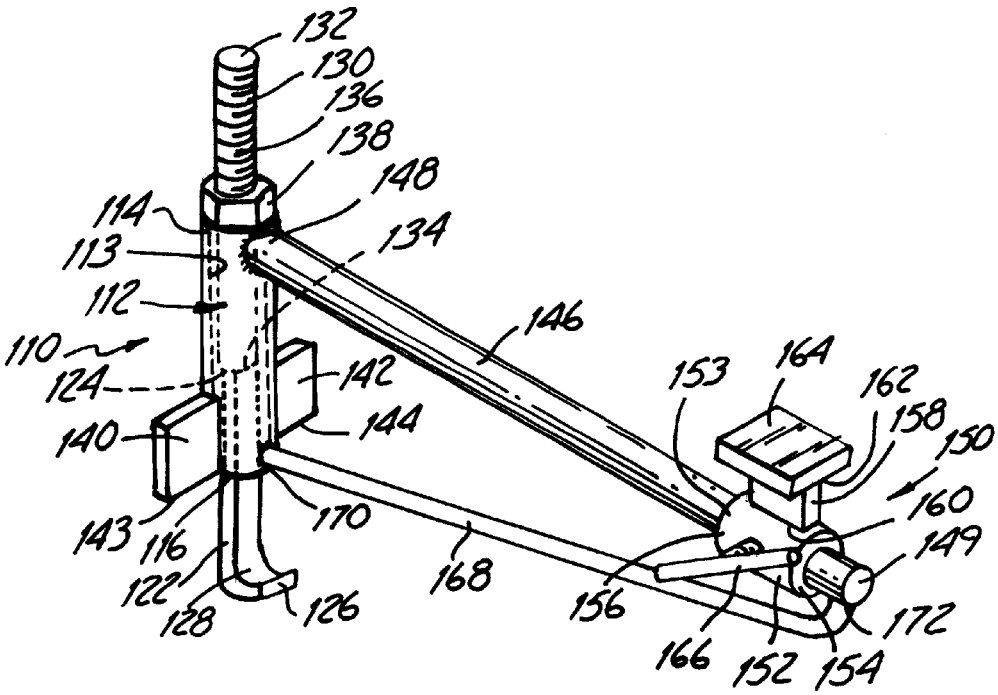
FIG. 4 is a perspective view of an alternative embodiment of the manhole cover engaging tool of the present invention.
Figure 5:
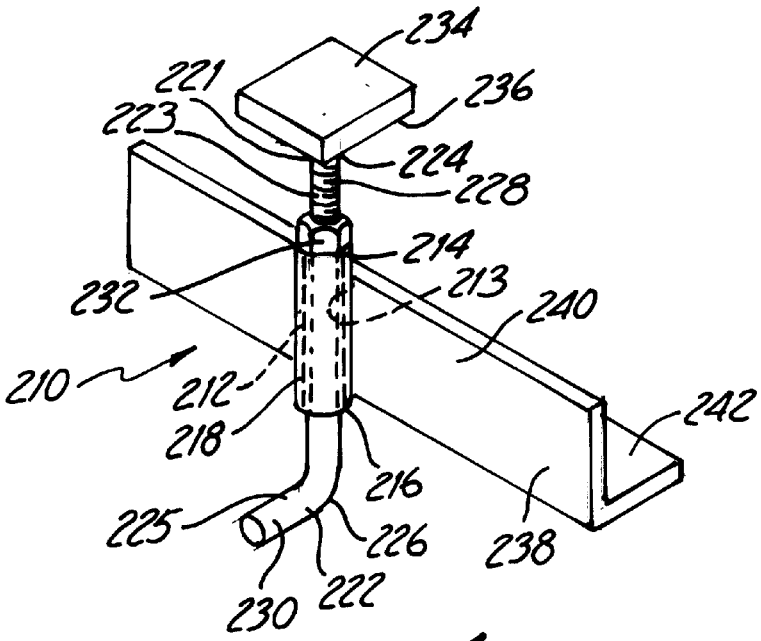
FIG. 5 is a perspective view of another alternative embodiment of the manhole cover engaging tool of the present invention.

The alternative embodiment 110 as illustrated in FIG. 4 includes a sleeve 112. The sleeve 112 is preferably a tubular steel material having an open interior cylindrical region 113 extending the length of the sleeve 112.

A hook-shaped member 122 has a first end 124 attached to a second end 134 of a threaded shaft 130, preferably by a weld. The hook-shaped member 122 includes a curved portion proximate a second end 126. The hook-shaped member 122 includes at least one flat surface 128 on the inside surface of the curved portion proximate the second end 126. Preferably, the hook-shaped member 122 has a rectangular cross section.

With the threaded shaft 130 attached to the hook-shaped member 122, a first end 132 of the threaded shaft 130 is inserted into the open interior region 113 of the sleeve 112 from a second end 116. The hook-shaped member 122 and the threaded shaft 130 are slidable within the open interior region 113. With the hook-shaped member 122 and the threaded shaft 130 inserted into the open interior region 113, the first end 132 of the adjusting member 130 extends beyond a first end 114 of the sleeve 112 while the second end 126 of the hook-shaped member 122 remains below the second end 116 of the sleeve 112.

A nut 138 threadably engages the threaded shaft 130. A corner to corner distance of the nut 138 is greater than a diameter of the open interior region 113 such that the nut 138 is prevented from entering the open interior region 113 of the sleeve 112.

With the sleeve 112 in a vertical position and the first end 114 above the second end 116, the nut 138 is adjacent to the first end 114 of the sleeve 112. As the nut 138 is rotated, the threaded shaft 130 is either raised or lowered relative to the first end 114 of the sleeve 112. Because the hook-shaped member 122 is fixedly attached to the threaded shaft 130, the hook-shaped member 122 is raised or lowered as the threaded shaft 130 is raised or lowered.

A first wing member 140 and a second wing member 142 are attached to the sleeve 112 proximate the second end 116 of the sleeve 112. Preferably, a bottom surface 142 of the first wing member 140 is even with the second end 116 of the sleeve 112. Opposite or 180 degrees away from the first wing member 140 is the second wing member 142 having a bottom surface 144 substantially even with the second end 116 of the sleeve 112. The first wing member 140 and the second wing member 144 are preferably rectangular in cross section.

A first end 148 of a bar 146 is attached to the sleeve 112 proximate the first end 114. The bar 146, as attached to the sleeve 112, is in a substantially orthogonal relationship to the first and second wing members 140, 142. Preferably, the bar 146 is circular in cross-section.

A lever attachment mechanism 150 is slidably attached to the bar 146. The lever attachment mechanism 150 includes a cylindrical member 152. The cylindrical member 152 has an inside diameter allowing the cylindrical member 152 to be disposed about the bar 146.

A first end 160 of an extension 158 is attached to the cylindrical member 152 substantially along a length of the cylindrical member 152. The extension 158 is preferably attached to the cylindrical member 152 by a weld. The extension 158 is preferably substantially rectangular in cross section.

A bottom surface of a plate is attached to a second end 162 of the extension 158, preferably by a weld. The plate 164 is substantially perpendicular to the extension 158. The plate 164 is substantially the same configuration as the first and second plates 28, 50 when the manhole cover engaging tool 10 is in the engaging position.

The cylindrical member 152 includes an aperture (not shown) within a wall 153 of the cylindrical member 152. The surface defining the aperture (not shown) is threaded such that a threaded bolt 166 engages the surface defining the aperture (not shown). As the bolt 166 threadably engages the aperture (not shown) an end (not shown) of the bolt 166 frictionally engages the bar 146, thereby securing the lever attachment mechanism 150 to the bar 146. Preferably, the aperture (not shown) is in a substantially orthogonal relationship to the vertical member 158.

A first end 170 of a support bar 168 is attached proximate the second end 116 of the sleeve 112. A second end 172 of the support bar 168 is attached to a second end 149 of the bar 146 such that the support bar 168 angles from the second end 116 of the sleeve 112 toward the second end 149 of the bar 146. A point of attachment of the support bar 146 to the main member 112 is in a substantially orthogonal relationship to the first wing member 140 and the second wing member 142. Additionally, the bar 146 and the support bar 168 are attached to the sleeve 112 and aligned about a common plane such that the bar 146 is above the support bar 168.

Figure 6:
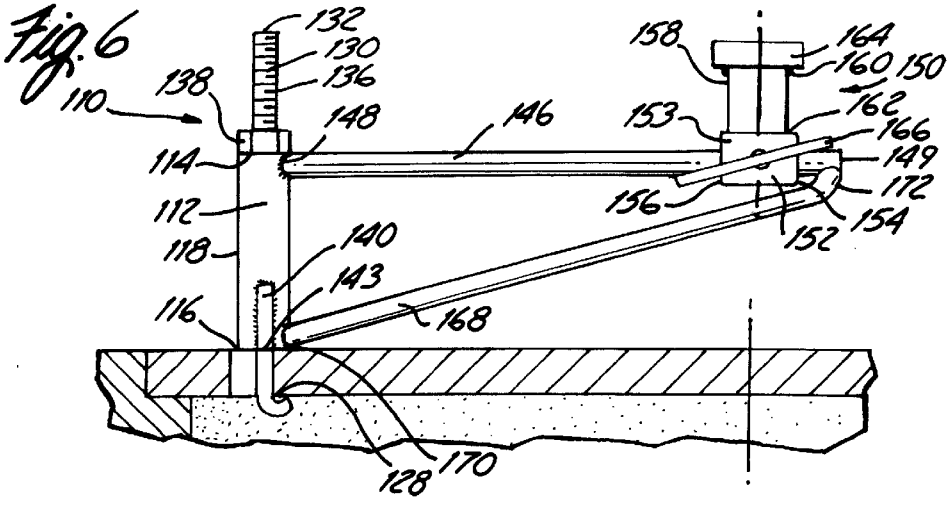
FIG. 6 is a partial sectional view of the alternative embodiment of FIG. 4 engaging a manhole cover having an off-center through hole.
Figure 7:
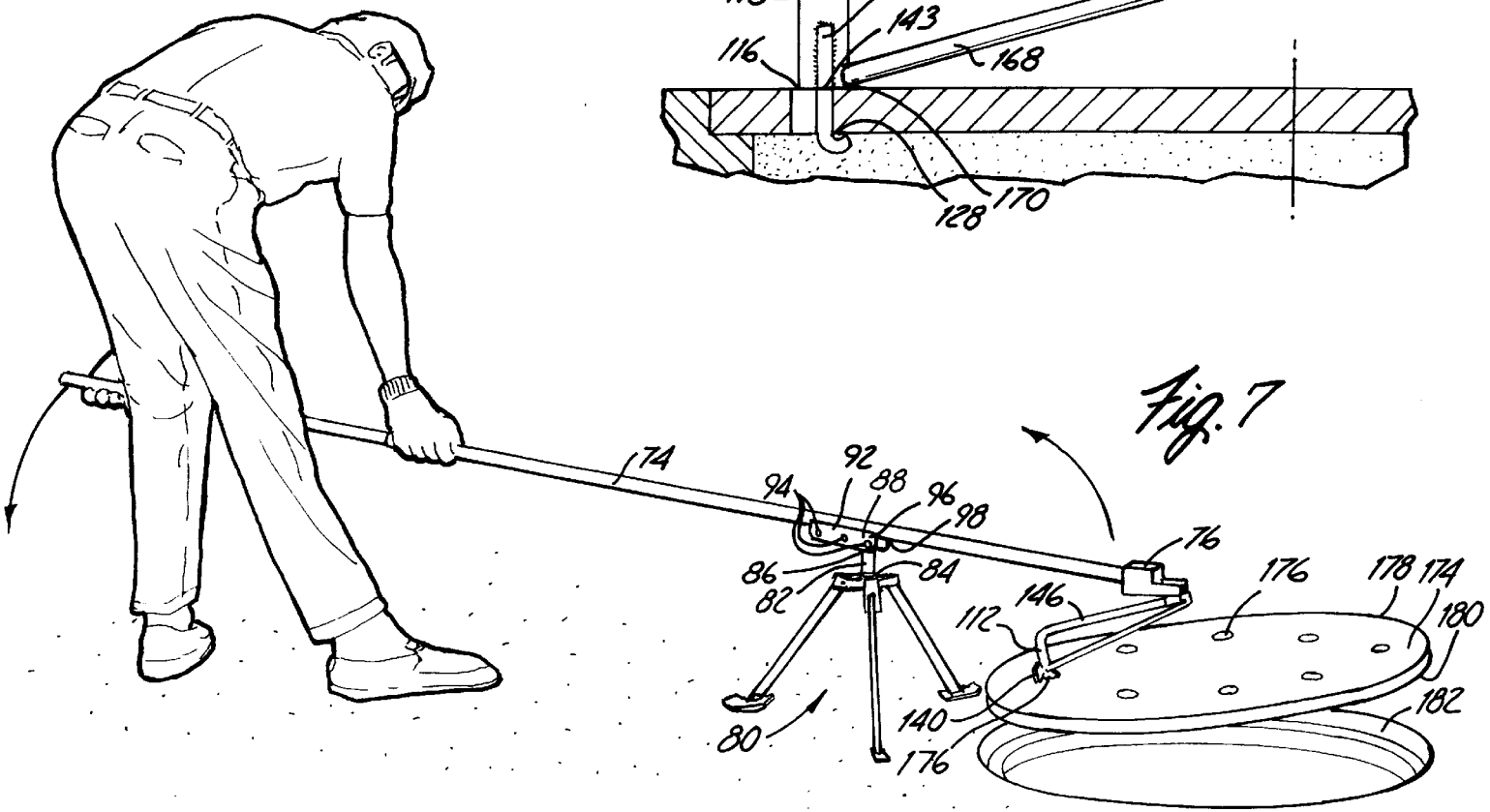
FIG. 7 is a perspective view of the alternative embodiment of FIG. 4 engaging a manhole cover having an off-center through hole.

In operation, the manhole cover engaging tool 110 preferably engages a manhole cover 174 having an off center through hole 176 as illustrated in FIGS. 6 and 7. The manhole cover engaging tool 110 is inserted through the through hole 176 in the manhole cover 174. The first and second wing members 140, 142 are positioned adjacent to an upper surface 178 of the manhole cover 174. The first and second wings 140, 142 prevent the sleeve 112 from accidentally sliding into the through hole 176 in the manhole cover 174. Additionally, the wings 140, 142 provide a contact surface with the upper surface 178 of the manhole cover 174 thereby preventing the manhole cover 174 from rotating about the manhole cover engaging tool 110 when the manhole cover 174 is raised.

With the manhole cover engaging tool 10 in position on the manhole cover 174, the nut 138 is rotated to raise the threaded shaft 130 and the hook-shaped member 122. The nut 138 is manipulated to shorten the distance between the wings 140, 142 and the second end 126 of the hook-shaped member 122 until a frictional engagement between the manhole cover 174 and the manhole cover engaging tool 110 is established as illustrated in FIG. 6. The frictional engagement of the manhole cover engaging tool 110 and the manhole cover 174 is established by engaging a bottom surface 180 of the manhole cover 174 with the second end 126 of the hook-shaped member 122, while the first and second wings 140,142 engage the upper surface 178 of the manhole cover 174.

The lever attachment mechanism 150 is positioned on the bar 146 approximately above the center of gravity of the manhole cover 174 as illustrated in FIG. 6. The bolt 166 is rotated to frictionally engage the lever attachment mechanism 150 to the bar 146 in the desired position.

Referring to FIG. 7 the first end 76 of the lever 74 engages the plate 164. A base 80 is positioned proximate the manhole 182. The lever 74 is attached to the base 80 between the first end 76 and the second end 77. The base 80 acts as a fulcrum for the lever 74, therefore a downward force applied to the second end 77 of the lever 74 causes an upward force to be exerted on the first end 76 of the lever 74, the manhole cover engaging tool 110, and the manhole cover 174, which causes the manhole cover 174 to be elevated.

The alternative embodiment 210 of the present invention is illustrated in FIG. 5. The manhole cover engaging tool 210 includes a cylindrical body 212 having an open interior region 213 defined by a wall 218. Cooperating with the cylindrical body 212 is an L-shaped member 222. The L-shaped member 222 includes a shank 223 and a finger 225 wherein a curved region 226 transitions the shank 223 into the finger 225. Preferably, the finger 230 and the shank 222 are formed from a single piece of material.

The shank 223 has a threaded region 228 proximate a first end 221. When the shank 223 is inserted through the open interior region 213, the first end 221, including a portion of the threaded surface 228 of the shank 223, extends beyond a first end 214 of the cylindrical member 212.

A nut 232 threadably engages the threaded surface 228 of the shank 223. A corner to corner distance of the nut 232 is greater than the diameter of the open interior region 213 within the cylindrical body 212 such that the nut 232 abuts the first end 214 of the cylindrical body 212.

Attached to the first end 224 of the shank 223 is a bottom surface 236 of a plate 234 having the same configuration as the plate 164 of the alternative embodiment 110. Preferably the plate 234 is welded to the first end 224 of the shank 223. Preferably the first end 224 of the shank 223 is substantially centrally located on the bottom surface 236 of the plate 234.

Attached to the wall 218 of the cylindrical member 212 is an angled member 238. Preferably the angled member 238 is made of steel. A vertical portion 240 of the angled member 238 is tangentially positioned against the wall 218 of the cylindrical body 212 and secured into a position preferably by a weld. Extending away from the cylindrical body 212 is a horizontal portion 242 of the angled member 238. The horizontal portion 242 is substantially even with a second end of 216 of the cylindrical body 212 and perpendicular to the vertical portion 240.

In operation, the manhole cover engaging tool 210 engages a manhole cover (not shown) with an off center through hole (not shown). The finger 225 is inserted through the through hole (not shown). The manhole cover engaging tool 210 is rotated such that the finger 225 is substantially parallel to a bottom surface (not shown) of the manhole cover (not shown) and the shank 223 is substantially perpendicular to the manhole cover (not shown). The nut 232 is rotated to raise the finger 225 relative to the manhole cover (not shown). The manhole cover engaging tool 210 frictionally engages the manhole cover (not shown) when the horizontal portion 242 of the angled member 238 is substantially adjacent to an upper surface of the manhole cover (not shown) and the finger 225 is adjacent to the bottom surface (not shown) of the manhole cover (not shown).

The first end 76 of the lever 74 engages the plate 234. The lever 74 is pivotally mounted to the base 86 wherein the base 86 acts as a fulcrum. A downward force is applied to the second end 77 of the lever 74 which raises the first end 76 of the lever 74, the manhole cover engaging tool 210 and the manhole cover (not shown). The manhole cover (not shown) is then pivoted away from the manhole (not shown) and lowered to a surface.

The embodiment 210 illustrated in FIG. 5 is capable of securely engaging manhole covers (not shown) having off center through holes because a length of the angled member 238 prevents rotation of the manhole cover (not shown) about the embodiment 210 caused by rotational inertia. Because the manhole cover (not shown) does not rotate, the manhole cover (not shown) is stable when raised from the manhole and pivotally moved away from the manhole.

Figure 8:
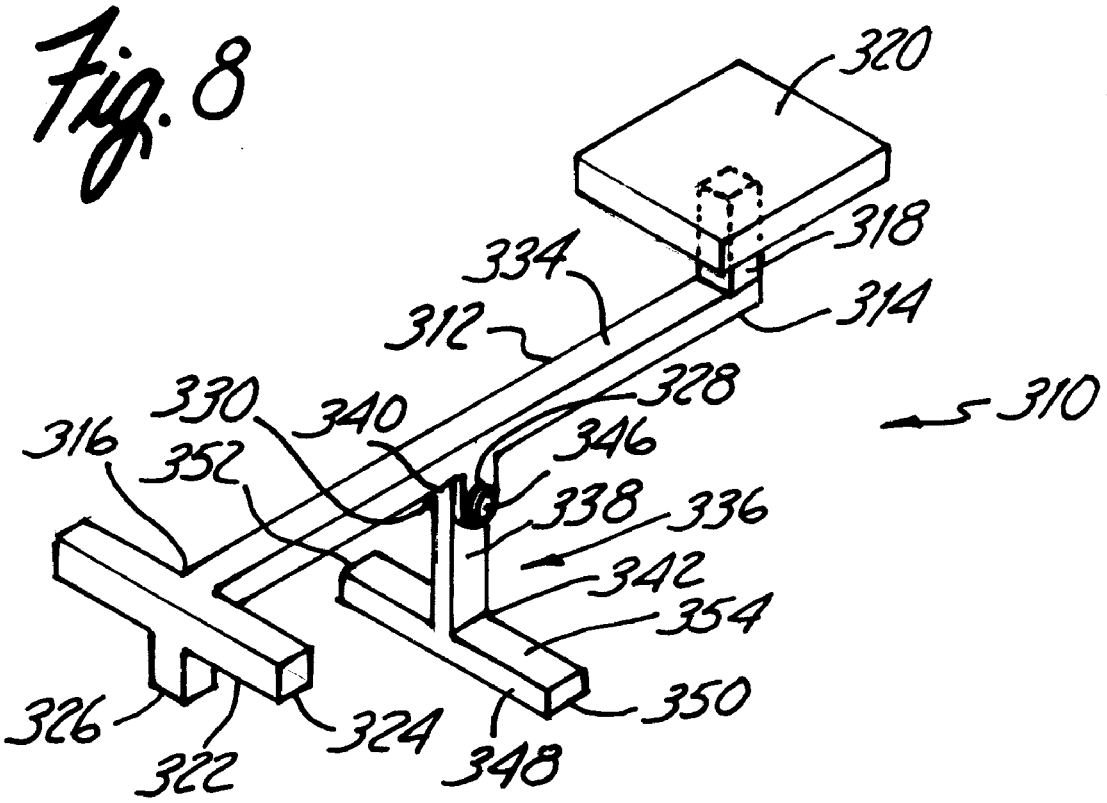
FIG. 8 is a perspective view of a grate engaging tool of the present invention.

Besides being useful in engaging manhole covers, another embodiment of the invention is useful in engaging grates, especially water run off grates. A grate engaging tool 310 is illustrated in FIG. 8 and includes a main member 312 having a first end 314 and a second end 316.

Attached to an upper surface 334 of the main member 312, proximate the first end 314, is an extension 318 extending substantially perpendicularly away from the main member 312. A plate 320 is attached to the member 318 wherein the plate 320 and the main member 312 are substantially parallel. The plate 320 is similar in configuration to the plate 26,50 and the plate 164, 234 of the embodiments 10, 110, 210, respectively, such that the same lever 74 can be used for each of the embodiments 10, 110, 210, 310.

Attached the second end 316 of the main member 312 is a cross member 322. The cross member 322 is substantially perpendicular to the main member 312 wherein the main member 312 substantially halves the cross member 322.

Extending from a bottom surface 324 of the cross member 322 is a stabilizing member 326. The stabilizing member 326 is substantially centrally located on the cross member 322 in an orthogonal relationship with the main member 312 and parallel to the extension 318.

Extending downwardly from the main member 312 are a first attaching member 328 and a second attaching member 330. The first attaching member 328 includes a first aperture (not shown). The second attaching member 330 includes a second aperture (not shown) aligned with the first aperture 332. The first attaching member 328 and the second attaching member 330 are substantially centrally located between the first end 314 and the second end 316.

A T-shaped member 336 is pivotally attached to the first and second attaching members 328, 330. A pin 346 is inserted through the first aperture (not shown) in the first attaching member 328, an aperture (not shown) in a vertical member 338 of the T-shaped member 336 proximate a first end 340, and the second aperture (not shown) in the second attaching member 330 thereby pivotally attaching the vertical member 338 to the main member 312.

Attached to the second end 342 of the vertical member 338 is a grate engaging member 348. The grate engaging member 348 is in a substantially perpendicular relationship to the vertical member 338. Preferably, the vertical member 338 is attached to the grate engaging member 348 by a weld substantially half way between a first end 350 and a second end 352.

In operation, the grate engaging member 348 is orientated substantially parallel to a plurality of bearing bars (not shown) within a grate (not shown). The grate engaging member 348 is lowered through a gap (not shown) between the plurality of bearing bars (not shown). Once the grate engaging member 348 is below a lower surface of the grate (not shown), the grate engaging tool 310 is rotated such that the grate engaging member 348 is substantially perpendicular to the plurality of bearing bars (not shown).

The stabilizing member 326 is inserted into a gap between the plurality of bearing bars (not shown) such that the bottom surface 324 of the cross member 322 is adjacent to a top surface of the grate (not shown).

A base 80 is positioned proximate the grate (not shown) and a lever 74 having a first end 76 and a second end 77 is pivotally attached to the base 80 wherein the base 80 acts as a fulcrum. The first end 76 of the lever 74 is configured to engage the plate 320. The lever 74 is the same lever 74 as used with the embodiments 10, 110, and 210.

A downward force is applied to the second end 77 of the lever 74 thereby raising the first end 76 of the lever 74. As the first end 76 of the lever 74 is raised, a top surface 354 of the grate engaging member 348 is adjacent to a bottom surface of the grate (not shown). Because the T-shaped member 336 is pivotally attached to the main member 312, the top surface 354 of the grate engaging member 348 remains adjacent to the bottom surface of the grate independent of the position of the main member 312 relative to the grate (not shown).

While the grate engaging member 348 exerts an upward force on the grate (not shown) as the first end 76 of the lever is raised, the cross member 322 exerts a downward force on the grate (not shown). The downward force exerted by the cross member 322 and the upward force exerted by the grate engaging member 348 stabilizes the grate (not shown) while being lifted.

Although the present invention has been described with reference to preferred embodiments, workers skilled in the art will recognize that changes may be made in form and detail without departing from the spirit and scope of the invention.

What is claimed is:

1. A manhole cover engaging tool comprising:

a first L-shaped member;

a second L-shaped member; and a hinge pivotally attaching the first L-shaped member and the second L-shaped member.

2. The manhole cover engaging tool of claim 1 wherein the first L-shaped member and the second L-shaped member are substantially rectangular in cross section.

3. The manhole cover engaging tool of claim 1 wherein a first section of the hinge is attached to a first shank of the first L-shaped member and a second section of the hinge is attached to a second shank of the second L-shaped member.

4. The manhole cover engaging tool of claim 1 and further comprising:

a first plate attached to a first end of the first L-shaped portion proximate the shank wherein the first plate and the shank are in a substantially orthogonal relationship; and a second plate attached to a first end of the second L-shaped member proximate the shank wherein the second plate and the shank are in a substantially orthogonal relationship.

5. The manhole cover engaging tool of claim 4 wherein the first plate and the second plate cooperate with an end of a lever when the manhole cover engaging tool is in an engaging position.

6. A method for lifting a manhole cover having a through hole wherein the method comprises:

rotating a first L-shaped member and a second L-shaped member of a manhole cover engaging tool about a hinge, rotating a first shank of the first L-shaped member adjacent a second shank of the second L-shaped portion such that a first finger of the first L-shaped member is substantially adjacent to a second finger of the second L-shaped member;

inserting the fingers of the first L-shaped member and the second L-shaped member of the manhole cover engaging tool through the through hole in the manhole cover;

manipulating the manhole engaging tool such that the shanks of the first and second L-shaped members are in a substantially perpendicular relationship to the manhole cover and the fingers of the first and second L-shaped members are in a substantially parallel relationship to the manhole cover;

rotating the first and second L-shaped members of the manhole cover engaging tool about the hinge such that the manhole cover engaging tool configures into an engaging position;

positioning a base with a lever attachment mechanism proximate the manhole cover;

operably connecting a lever to the base with the lever attachment mechanism such that an end of the lever proximate the manhole cover moves in a vertical plane and a horizontal plane;

operably attaching the end of the lever proximate the manhole cover to the manhole cover engaging tool;

applying a downward force to an end of the lever, distal the manhole cover, thereby elevating the manhole cover above a manhole;

pivoting the manhole cover away from the manhole by moving the lever in a horizontal direction; and lowering the manhole cover to a surface by raising the end of the lever distal the manhole.

7. The method of claim 6 wherein the base includes a tripod configuration.

8. The method of claim 6 wherein the lever attachment mechanism comprises a cylindrical member wherein a first end of the cylindrical member rotatably attaches to the base and the cylindrical member pivotally attaches to lever.

* * * * *